US011417269B2

(12) United States Patent
Choi et al.

(10) Patent No.: US 11,417,269 B2
(45) Date of Patent: Aug. 16, 2022

(54) DISPLAY DEVICE AND DRIVING METHOD FOR THE SAME

(71) Applicant: LG Display Co., Ltd., Seoul (KR)

(72) Inventors: Seokhwan Choi, Paju-si (KR); Jung-Min Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/386,420

(22) Filed: Jul. 27, 2021

(65) Prior Publication Data

US 2022/0208078 A1 Jun. 30, 2022

(30) Foreign Application Priority Data

Dec. 24, 2020 (KR) ..... 10-2020-0183136

(51) Int. Cl.
*G09G 3/32* (2016.01)

(52) U.S. Cl.
CPC ..... *G09G 3/32* (2013.01); *G09G 2310/027* (2013.01); *G09G 2310/061* (2013.01); *G09G 2310/08* (2013.01); *G09G 2330/028* (2013.01); *G09G 2360/16* (2013.01)

(58) Field of Classification Search
CPC ..... G09G 3/32; G09G 2310/027; G09G 2310/061; G09G 2310/08; G09G 2330/028; G09G 2360/16
See application file for complete search history.

(56) References Cited

U.S. PATENT DOCUMENTS

2018/0374415 A1* 12/2018 Morita ..... H01L 27/1251
2019/0304386 A1* 10/2019 Kim ..... G09G 3/32
2020/0035148 A1* 1/2020 Xuan ..... G09G 3/32
2020/0160779 A1* 5/2020 Lee ..... G09G 3/3233
2020/0193910 A1* 6/2020 Park ..... G09G 3/3258
2020/0357332 A1* 11/2020 Hung ..... G09G 3/3233
2020/0357346 A1* 11/2020 Pyun ..... G09G 3/3266

* cited by examiner

*Primary Examiner* — Andrew Sasinowski
(74) *Attorney, Agent, or Firm* — Fenwick & West LLP

(57) ABSTRACT

A display apparatus according to embodiments of the present disclosure includes a display panel including at least one light emitting element that emits light according to a difference in respective voltages applied to an anode electrode and a cathode electrode, and including a plurality of pixels that are connected to a plurality of data lines, a plurality of gate lines, and a plurality of light emitting control lines, wherein a reset voltage is supplied to the anode electrode, a data driver for supplying data signals to the data lines, a gate driver for supplying gate signals to the gate lines, and supplying a light emitting control signal to each of the light emitting control lines, and a timing controller for controlling the data driver and the gate driver, and enabling the reset voltage to be supplied in sync with a plurality of non-light emitting periods of the light emitting control signal included in one frame.

13 Claims, 8 Drawing Sheets

DISPLAY DEVICE AND DRIVING METHOD FOR THE SAME

CROSS-REFERENCE TO RELATED APPLICATION

This application claims the priority benefit of Korean Patent Application No. 10-2020-0183136, filed on Dec. 24, 2020 in the Korean Intellectual Property Office, the disclosure of which is incorporated herein by reference in its entirety.

TECHNICAL FIELD

The present disclosure relates to display apparatuses and driving methods of the display apparatuses.

DESCRIPTION OF THE RELATED ART

As the information-oriented society has been developed, various needs for display apparatuses for displaying an image have increased. To satisfy such needs, various types of display apparatuses, such as a Liquid Crystal Display (LCD) apparatus, an Electroluminescence Display (ELD) apparatus, and the like have been developed and utilized.

The Electroluminescence Display (ELD) apparatus includes a Quantum-dot Light Emitting Display apparatus including a quantum dot (QD), an Inorganic Light Emitting Display apparatus, and an Organic Light Emitting Display apparatus, and the like.

Among these display apparatuses, the ELD apparatus has characteristics of a short response time, a wide viewing angle, excellent color gamut, and the like. Further, the ELD apparatus has an advantage that may be implemented as a thin thickness.

The ELD apparatus generally includes a plurality of pixels that are arranged in a matrix form. In such a display apparatus, there sometimes occur differences in brightness due to differences between threshold voltages of respective pixels, which results in the image quality of the display being poor.

SUMMARY

Accordingly, embodiments of the present disclosure are directed to a display apparatus that substantially obviates one or more problems due to limitations and disadvantages of the related art.

Embodiments of the present disclosure provide a display apparatus and driving methods of the display apparatus for improving display quality.

Additional features and aspects will be set forth in part in the description that follows, and in part will become apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

According to an aspect of the present disclosure, a display apparatus comprises a display panel including at least one light emitting element that emits light according to a difference in respective voltages applied to an anode electrode and a cathode electrode, and including a plurality of pixels that are connected to a plurality of data lines, a plurality of gate lines, and a plurality of light emitting control lines, wherein a reset voltage is supplied to the anode electrode, a data driver for supplying data signals to the data lines, gate drivers for supplying gate signals to the gate lines, and supplying a light emitting control signal to each of the light emitting control lines, and a timing controller for controlling the data driver and the gate driver, and enabling the reset voltage to be supplied in sync with a plurality of non-light emitting periods of the light emitting control signal included in one frame.

In another aspect of the present disclosure, a method of driving a display apparatus comprises calculating luminance of one frame of images displayed on a display panel, comparing the calculated luminance with first luminance and, when the calculated luminance is lower than the first luminance, enabling the display panel to be operated in a plurality of light emitting periods and a plurality of non-light emitting periods in the one frame, supplying a reset voltage to the display panel according to the plurality of non-light emitting periods, and enabling light emitting to be performed in the display panel according to the plurality of light emitting periods in the one frame.

According to embodiments of the present disclosure, it is possible to provide display apparatuses and driving methods of the display apparatuses for improving display quality.

It is to be understood that both the foregoing general description and the following detailed description of the present disclosure are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain principles of the disclosure.

DETAILED DESCRIPTION

Figure 1:
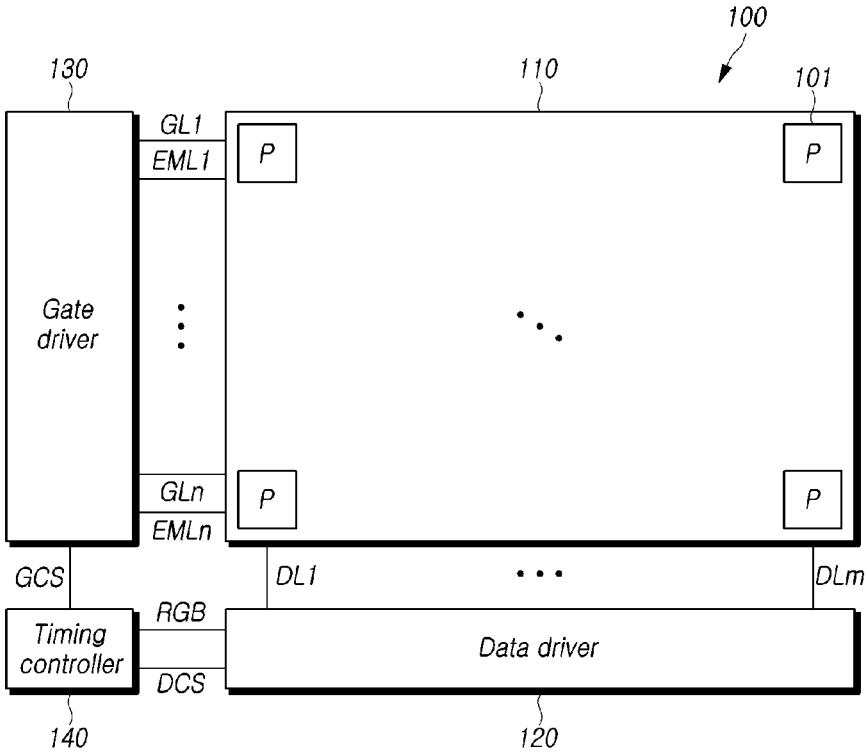
FIG. 1 illustrates a system configuration of a display apparatus according to an embodiment of the present disclosure.

The advantages and features of the present disclosure and methods of achieving the same will be apparent by referring to embodiments of the present disclosure as described below in detail in conjunction with the accompanying drawings. However, the present disclosure is not limited to the embodiments set forth below, but may be implemented in various different forms. The following embodiments are provided only to completely disclose the present disclosure and inform those skilled in the art of the scope of the present disclosure, and the present disclosure is defined only by the scope of the appended claims.

In addition, the shapes, sizes, ratios, angles, numbers, and the like illustrated in the accompanying drawings for describing the exemplary embodiments of the present disclosure are merely examples, and the present disclosure is not limited thereto. Like reference numerals generally denote like elements throughout the present specification. Further, in the following description of the present disclosure, detailed description of well-known functions and configurations incorporated herein will be omitted when it is determined that the description may make the subject matter in some embodiments of the present disclosure rather unclear. The terms such as "including", "having", "containing", and "comprising of" used herein are generally intended to allow other components to be added unless the terms are used with the term "only". Singular forms used herein are intended to include plural forms unless the context clearly indicates otherwise.

In interpreting any elements or features of the embodiments of the present disclosure, it should be considered that any dimensions and relative sizes of layers, areas and regions include a tolerance or error range even when a specific description is not conducted.

Spatially relative terms, such as, "on", "over", "above", "below", "under", "beneath", "lower", "upper", "near", "close", "adjacent", and the like, may be used herein to describe one element or feature's relationship to another element(s) or feature(s) as illustrated in the figures, and it should be interpreted that one or more elements may be further "interposed" between the elements unless the terms such as 'directly', "only" are used.

Time relative terms, such as "after", "subsequent to", "next to", "before", or the like, used herein to describe a temporal relationship between events, operations, or the like are generally intended to include events, situations, cases, operations, or the like that do not occur consecutively unless the terms, such as "directly", "immediately", or the like, are used.

When embodiments related to signal flows are discussed, for example, an embodiment where a signal is transmitted from node A to node B may include the transmission of the signal from node A to node B by way of another node unless 'direct' or 'directly' is used.

When the terms, such as "first", "second", or the like, are used herein to describe various elements or components, it should be considered that these elements or components are not limited thereto. These terms are merely used herein for distinguishing an element from other elements. Therefore, a first element mentioned below may be a second element in a technical concept of the present disclosure.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, embodiments of the present disclosure will be described in detail with reference to the accompanying drawings. For convenience of description, a scale of each of elements illustrated in the accompanying drawings differs from a real scale, and thus, is not limited to a scale illustrated in the drawings.

FIG. 1 illustrates a system configuration of a display apparatus according to an embodiment of the present disclosure.

With reference to FIG. 1, the display apparatus 100 includes a display panel 110, a data driver 120, a gate driver 130, and a timing controller 140.

The display panel 110 may include a plurality of pixels that are arranged in a matrix form. The plurality of pixels 101 each may emit a red color, a green color, a blue color, or the like. However, light emitted by each pixel 101 according to embodiments herein is not limited thereto. For example, the pixel 101 may emit a white color. Further, the pixel 101 may have a rectangular shape. Each pixel 101 can include a light emitting element that emits light responsive to a difference in respective voltages applied to an anode electrode and a cathode electrode, and a pixel circuit for supplying a driving current to the light emitting element.

The display panel 110 may include a plurality of gate lines (GL1 to GLn), a plurality of data lines (DL1 to DLm), and a plurality of pixels each connected with each of the plurality of gate lines (GL1 to GLn) and each of the plurality of data lines (DL1 to DLm). Each pixel 101 may receive a data signal through each of the plurality of data lines (DL1 to DLm) according to a gate signal delivered through each of the plurality of gate lines (GL1 to GLn) The display panel 110 may further include a plurality of light emitting control lines (EML1 to EMLn) for delivering light emitting control signals. However, lines disposed in the display panel 110 according to embodiments herein are not limited thereto.

Further, a reset voltage may be applied to an anode electrode in the display panel 110. For example, a level of a voltage applied to the anode electrode may be reduced by the applied reset voltage.

The data driver 120 is connected to the plurality of data lines (DL1 to DLm), and may transmit data signals to the pixels 101 through the plurality of data lines (DL1 to DLm). Here, although FIG. 1 shows a single data driver 120, embodiments of the present disclosure are not limited thereto. For example, the data driver includes a plurality of data drivers.

The gate driver 130 is connected to the plurality of gate lines (GL1 to GLn), and may transmit gate signals to the pixels 101 through the plurality of gate lines (GL1 to GLn). Further, the gate driver 130 may be connected to the plurality of light emitting control lines (EML1 to EMLn). Here, although FIG. 1 shows that the gate driver 130 is disposed in one side of the display panel 110, embodiments of the present disclosure are not limited thereto. For example, gate drivers 130 may be disposed in two sides or both sides of display panel 110. Further, one of two or more gate drivers may be connected to odd-numbered gate lines, and another, or the other, of the gate drivers may be connected to even-numbered gate lines. Further, the display apparatus 100 may include a gate signal generation circuit providing gate signals to the display panel 110 without including a separate gate driver.

The timing controller 140 may control the data driver 120 and the gate driver 130. The timing controller 140 may supply image signals (RGB) and data control signals (DCS) to the data driver 120, and supply gate control signals GCS to the gate driver 130.

Figure 2:
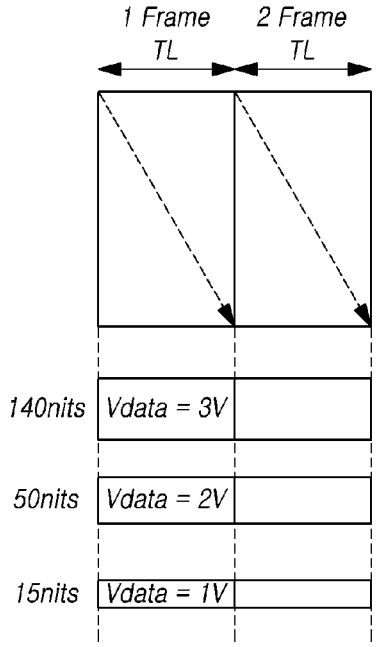
FIG. 2 illustrates a method of driving a display apparatus according to an embodiment of the present disclosure.

FIG. 2 illustrates a method of driving a display apparatus according to an embodiment of the present disclosure.

With reference to FIG. 2, in the display apparatus 100, as gate signals are sequentially applied to the plurality of gate lines (GL1 to GLn) of the display panel 110, and data signals are input to pixels 101 connected to the gate lines to which the gate signals are applied, the corresponding pixels 101 may operate to emit light.

When images including a plurality of frames are supplied to the display panel 110, data signals Vdata are written to the pixels 101 in a first frame (1 Frame) and a second frame (2 Frame) at respective times, and respective light emitting elements included in the pixels 101 may emit light corresponding to the written data signals Vdata.

Further, the display panel 110 can display images with various luminance. In this instance, such luminance may correspond to a voltage level of the data signal Vdata. For example, when a voltage level of a data signal Vdata is greater than or equal to 3V, the luminance of the display panel 110 may become 150 nit or more. When a voltage level of a data signal Vdata is between 2V and 3V, the luminance of the display panel 110 may become between 50 nit and 150 nit. When a voltage level of a data signal Vdata is between 1V and 2V, the luminance of the display panel 110 may become between 15 nit and 50 nit.

Figure 3:
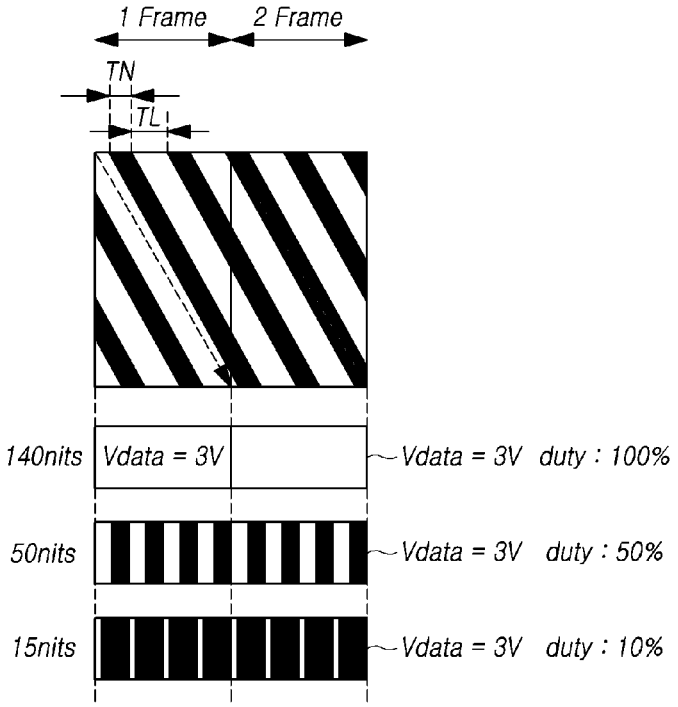
FIG. 3 illustrates a method of driving a display apparatus according to an embodiment of the present disclosure.

FIG. 3 illustrates a method of driving a display apparatus according to an embodiment of the present disclosure.

With reference to FIG. 3, in the display apparatus 100, as gate signals are sequentially applied to the plurality of gate lines (GL1 to GLn) of the display panel 110, and data signals Vdata are input to pixels 101 connected to the gate lines to which the gate signals are applied, the corresponding pixels 101 may operate to emit light. Further, the luminance of images displayed through the display panel may be adjusted by applying a light emitting control signal EMS to a plurality of light emitting control lines EML, and adjusting a pulse width of the light emitting control signal EMS.

In order for the display panel to display images in a plurality of frames including a first frame (1 Frame) and a second frame (2 Frame), data signals Vdata can be sequentially written to the pixels 101, and then, driving current generated in response to the written data signals Vdata may be supplied to light emitting elements included in the pixels according to light emitting control signals EMS, and as a result, pixels may emit light.

The light emitting control signal EMS may include a plurality of first pulses. For each frame, each of a plurality of light emitting periods TL and each of a plurality of non-light emitting periods TN may be alternately represented on the display panel 110 on which the first frame (1 Frame) and the second frame (2 Frame) are represented. In a situation where each light emitting period TL and each non-light emitting period TN are alternately represented for each frame, when a low luminance image is displayed, users may not perceive the occurrence of a flicker.

The plurality of non-light emitting periods TN may correspond to the plurality of first pulses. The light emitting control signal may be adjusted by a duty ratio which is a ratio between a light emitting period TL and a non-light emitting period TN.

Here, as a duty ratio is lower, a length of a light emitting period TL may become smaller and a length of a non-light emitting period TN may become larger, and as the duty ratio is higher, the length of the light emitting period TL may become larger and the length of the non-light emitting period TN may become smaller. That is, as the duty ratio is higher, a length of the first pulses included in a light emitting control signal EMS may become smaller.

The display panel 110 may display images with various luminances, and such luminance may correspond to a voltage level of a data signal Vdata and a duty ratio of a light emitting control signal EMS. For example, when luminance on the display panel 110 by a displayed image is greater than or equal to 150 nit, a voltage level of a corresponding data signal Vdata may be greater than or equal to 3V, and a duty ratio of a corresponding light emitting control signal EMS may be 100%. For example, as the light emitting control signal maintains a constant voltage, in one frame, a non-light emitting period TN may not be present or have a very short period. When luminance on the display panel 110 by a displayed image is 50 nit, a voltage level of a corresponding data signal may be 3V, and a duty ratio of a corresponding light emitting control signal may be 50%. That is, respective lengths of a light emitting period TL and a non-light emitting period TN may be equal. Further, when luminance on the display panel 110 by a displayed image is 15 nit, a voltage level of a corresponding data signal may be 3V, and a duty ratio of a corresponding light emitting control signal may be 10%. That is, a ratio between a length of a light emitting period TL and a length of a non-light emitting period TN may be 1:9.

Accordingly, even when a voltage level of a data signal Vdata is constant, if a ratio between a length of a light emitting period TL of a light emitting control signal EMS and a length of a non-light emitting period TN thereof is adjusted, luminance of the display apparatus 100 may be adjusted.

Figure 4:
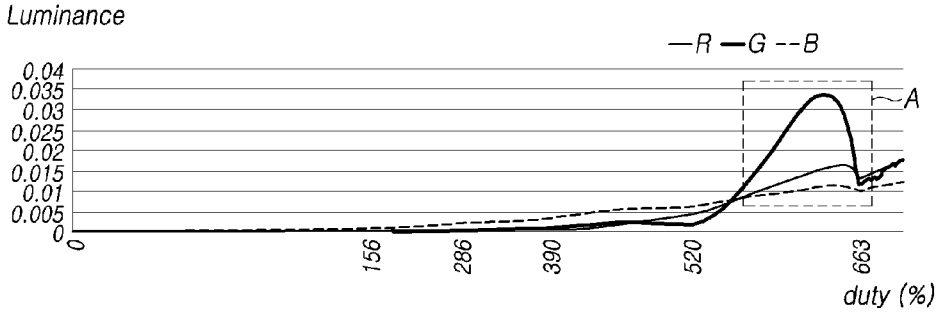
FIG. 4 is a graph showing luminance measured in a display panel for each duty ratio in the driving method of the display apparatus illustrated in FIG. 3.

FIG. 4 is a graph showing luminance measured in a display panel for each duty ratio in the method of driving the display apparatus illustrated in FIG. 3.

In FIG. 4, an x-axis represents duty ratios increasing from left to right, and a y-axis represents luminance displayed on the display panel 110. The luminance of the display panel 110 in the y-axis represents low gray scales. Further, in the graph, luminance is represented in situations where on the display panel 110, red-colored light R is emitted by red pixels, green-colored light G is emitted by green pixels, and blue-colored light B is emitted by blue pixels.

As a duty ratio increases, a length of a light emitting period TL becomes larger. Thus, as illustrated in FIG. 4, as the duty ratio increases, luminance values of red, green, and blue light on the display panel 110 should be increased. However, in region A, even though a duty ratio is relatively high, respective luminance of red, green, and blue light on the display panel 110 is reduced. That is, in the A region, as the luminance is rapidly increased, there is a problem in that a period is present that represents luminance higher than luminance in a situation having a higher duty ratio.

Figure 5:
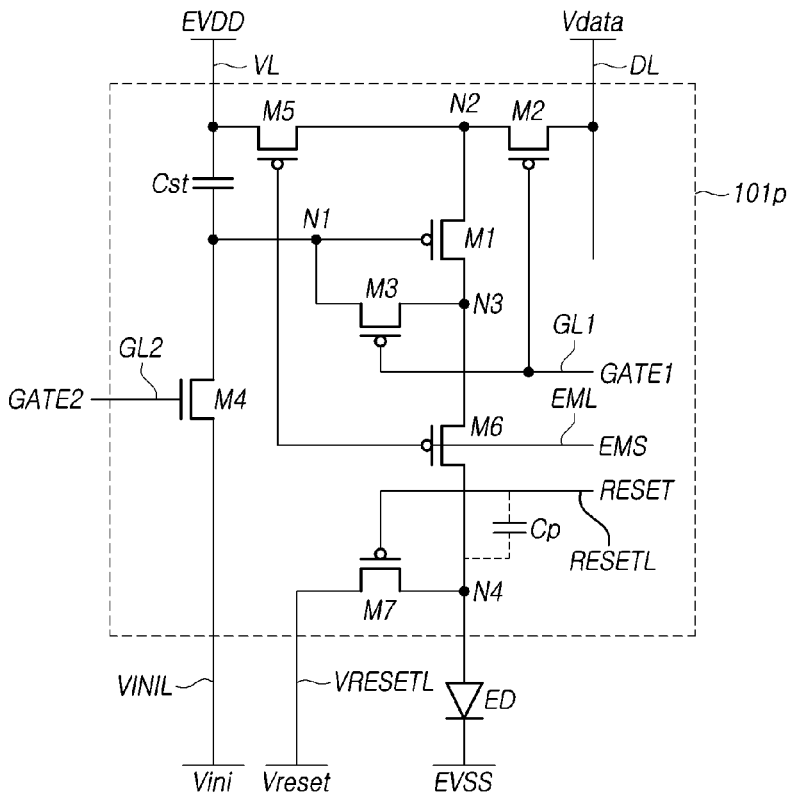
FIG. 5 is a circuit diagram illustrating a pixel illustrated in FIG. 1.

FIG. 5 is a circuit diagram illustrating a pixel illustrated in FIG. 1.

With reference to FIG. 5, a pixel 101 may include a first transistor M1 for supplying a driving current from a second node N2 to a third node N3 by a voltage supplied to a first node N1 and a first power supply voltage EVDD supplied to the second node N2, a second transistor M2 for supplying a data signal to the second node N2 according to a first gate signal GATE1, a capacitor Cst disposed between the first power supply voltage EVDD and the first node N1, a third transistor M3 for connecting between the first node N1 and the third node N3 according to the first gate signal GATE1, a fourth transistor M4 for supplying an initialization voltage Vini to the first node N1 according to a second gate signal GATE2, a fifth transistor M5 for supplying the first power supply voltage EVDD to the second node N2 according to a light emitting control signal EMS, a sixth transistor M6 for supplying a driving current supplied to the third node N3 to a fourth node N4 according to the light emitting control signal EMS, a seventh transistor M7 for supplying a reset voltage Vreset to the fourth node N4 according to a reset signal RESET, and a light emitting element ED, such as a light emitting diode, or an organic light emitting diode, receiving a driving current supplied to the fourth node N4.

A first electrode of the first transistor M1 may be connected to the second node N2, and a second electrode of the first transistor M1 may be connected to the third node N3. Further, a gate electrode of the first transistor M1 may be connected to the first node N1. The first transistor M1 may allow a driving current to flow from the second node N2 to the third node N3 according to a voltage applied to the first node N1.

A first electrode of the second transistor M2 may be connected to a data line DL and a second electrode of the second transistor M2 may be connected to the second node N2. Further, a gate electrode of the second transistor M2 may be connected to the first gate line GL1. The second transistor M2 may allow a data signal Vdata delivered through the data line DL to be delivered to the second node N2 according to the first gate signal GATE1 delivered through a first gate line GL1.

A first electrode of the capacitor Cst may be connected to the first node N1 and a second electrode of the capacitor Cst may be connected to a power supply line VL supplying the first power supply voltage EVDD, respectively. The capacitor Cst may be maintained a voltage of the first node N1.

A first electrode of the third transistor M3 may be connected to the third node N3 and a second electrode of the third transistor M3 may be connected to the first node N1. Further, a gate electrode of the third transistor M3 may be connected to the first gate line GL1. The third transistor M3 may connect between the first node N1 and the third node N3 according to the first gate signal GATE1 delivered through the first gate line GL1. When the first node N1 and the third node N3 are connected, the first transistor M1 may be electrically connected to a light emitting diode such as organic light emitting diode, and thus, allow a corresponding current to flow from the second node N2 to the third node N3.

A first electrode of the fourth transistor M4 may be connected to an initialization voltage line VINIL and a second electrode of the fourth transistor M4 may be connected to the first node N1. Further, a gate electrode of the fourth transistor M4 may be connected to a second gate line GL2. The fourth transistor M4 may allow the initialization voltage Vini transmitted from the initialization voltage line VINIL to be applied to the first node N1 according to a second gate signal GATE2 delivered through the second gate line GL2.

A first electrode of the fifth transistor M5 may be connected to the power supply line VL and second electrode of the fifth transistor M5 may be connected to the second node N2. Further, a gate electrode of the fifth transistor M5 may be connected to a light emitting control line EML. The fifth transistor M5 may apply the first power supply voltage EVDD transmitted from the power supply line VL to the second node N2 according to a light emitting control signal EMS delivered through the light emitting control line EML.

A first electrode of the sixth transistor M6 may be connected to the third node N3 and a second electrode of the sixth transistor M6 may be connected to the fourth node N4. Further, a gate electrode of the sixth transistor M6 may be connected to the light emitting control line EML. The sixth transistor M6 may electrically connect between the third node N3 and the fourth node N4, and thus, allow a driving current to flow from the third node N3 to the fourth node N4 according to the light emitting control signal EMS delivered through the light emitting control line EML.

A first electrode of the seventh transistor M7 may be connected to a reset voltage line VRESET and a second electrode of the seventh transistor M7 may be connected to the fourth node N4. Further, a gate electrode of the seventh transistor M7 may be connected to a reset signal line RESETL. The seventh transistor M7 may apply a reset voltage Vreset transmitted from the reset voltage line VRESET to the fourth node N4 according to a reset signal RESET delivered through the reset signal line RESETL.

The light emitting element ED may include an anode electrode, a cathode electrode, and an emissive layer disposed between the anode electrode and the cathode electrode and emitting light when a current flows. The anode electrode of the light emitting element ED may be connected to the fourth node N4 and the cathode electrode of the light emitting element ED may be connected to a second power supply voltage EVSS. The emissive layer may include at least one of an organic material, an inorganic material, and a quantum dot material. The light emitting element ED may emit light by a driving current flowing through the emissive layer according to a difference in voltages between the anode electrode and the cathode electrode.

The light emitting control line EML connected to the gate electrode of the sixth transistor M6 may be adjacent to the fourth node N4 connected to the anode electrode of the light emitting element ED. Further, the light emitting control line EML and the fourth node N4 may overlap with each other. The fourth node N4 may be a node at which at least one of the sixth and seventh transistors M6 and M7 and the anode electrode is connected with each other.

Figure 6:
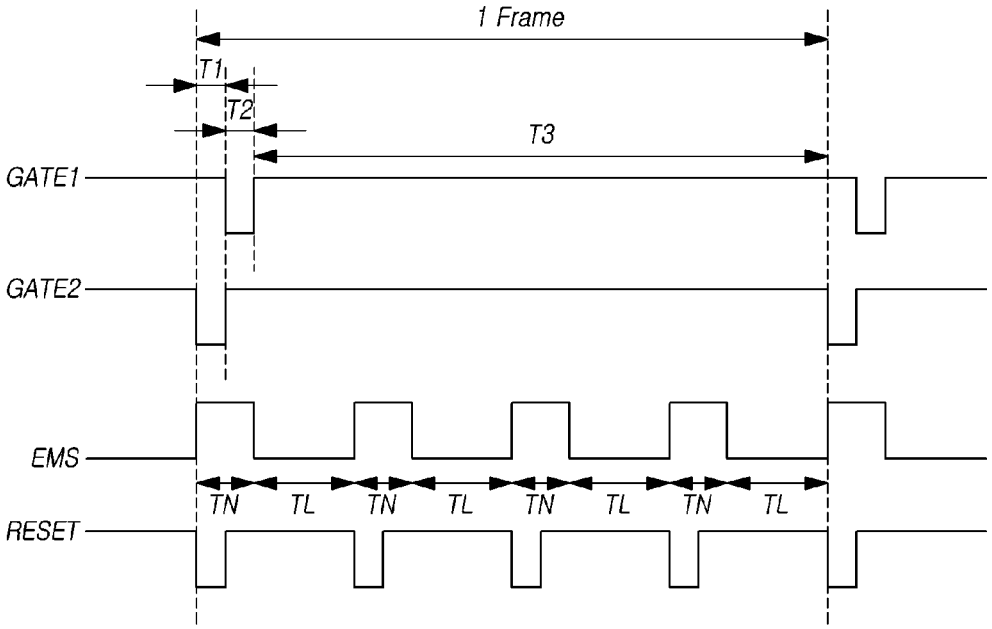
FIG. 6 is a timing diagram illustrating the operation of the pixel illustrated in FIG. 5.

FIG. 6 is a timing diagram illustrating the operation of the pixel illustrated in FIG. 5.

With reference to FIG. 6, each of the first to seventh transistors (M1 to M7) of the pixel 101 may turn on by receiving any one of a first gate signal GATE1, a second gate signal GATE2, a light emitting control signal EMS, and a reset signal RESET. The first to seventh transistors (M1 to M7) are shown as NMOS transistors; thus, when high signals are applied to gate electrodes of the first to seventh transistors (M1 to M7), these transistors turn off, and when low signals are applied to gate electrodes thereof, these transistors turn on.

In a first period T1, the first gate signal GATE1 may be supplied in a high state and the second gate signal GATE2 may be supplied in a low state. Further, in the first period T1, the light emitting control signal EMS may be supplied in a high state, and the reset signal RESET may be supplied in a low state corresponding to the light emitting control signal EMS.

In the first period T1, the fourth transistor M4 may turn on by the second gate signal GATE2, and as a result, a voltage at the first node N1 may be initialized by an initialization voltage Vini transmitted from the initialization voltage line VINIL. Further, in the first period T1, the seventh transistor may turn on by the reset signal RESET, and as a result, a reset voltage Vreset may be applied to the fourth node N4. When the reset voltage Vreset is applied, a voltage level at the fourth node N4 may decrease. The reset voltage Vreset may have a voltage level lower than a threshold voltage of the light emitting element ED. Accordingly, even when the reset voltage Vreset is applied to the light emitting element ED, the light emitting element ED may not emit light.

In a second period T2, the first gate signal GATE1 may be supplied in a low state and the second gate signal GATE2 may be supplied in a high state. Further, in the second period T2, the light emitting control signal EMS may be supplied in the high state, and the reset signal RESET may be supplied in a high state. That is, the reset signal RESET may maintain the low state for a time period of one horizontal synchronization signal (1H).

In the second period T2, when the first gate signal GATE1 is supplied in the low state, the second and third transistors M2 and M3 may turn on. When the second transistor M2 turns on, a data signal Vdata delivered through the data line DL may be delivered to the second node N2, and as the third transistor M3 turns on as well, the first transistor M1 may be electrically connected to the diode. Thus, a current may flow from the second node N2 to the third node N3.

As the capacitor Cst is connected to the first node N1, thus, the data signal Vdata and a voltage corresponding to a threshold voltage of the first transistor M1 may be stored in the capacitor Cst. Accordingly, in the second period T2, a data signal compensating for the threshold voltage of the first transistor M1 may be stored in the capacitor Cst. In this situation, as the fifth and sixth transistors M5 and M6 are in a turn-off state by the light emitting control signal EMS, current may not flow from the third node N3 to the fourth node N4. Further, the reset voltage Vreset transmitted to the fourth node N4 in the first period T1 may be maintained.

Further, in a third period T3, the display panel 110 may operate in light emitting periods TL and non-light emitting periods TN. The light emitting control signal EMS may repeat the high state and a low state in the third period T3. When the light emitting control signal EMS is in the high state, the display apparatus 100 operates in the non-light emitting period TN in which the light emitting element ED does not emit light, and when the light emitting control signal EMS is in the low state, the display apparatus 100 operates in the light emitting period TL in which the light emitting element ED emits light. Further, according to luminance of images displayed in the display apparatus 100, a duty ratio, which is a ratio between a length of the light emitting period TL and a length of the non-light emitting period TN, may be adjusted.

As the light emitting control signal EMS repeatedly transitions between the high state and the low state, thus, the light emitting control signal EMS may include a plurality of first pulses having periodically the high state. Further, the plurality of first pulses may correspond to the non-light emitting period TN. The reset signal RESET may be supplied in sync with the plurality of first pulses of the light emitting control signal EMS. That is, when the light emitting control signal EMS transitions to the high state, the reset signal RESET may transition to the low state.

The reset signal RESET may include a plurality of second pulses having periodically the low state. However, as the reset signal RESET may maintain its state for the time period of one horizontal synchronous signal, the reset signal RESET may transition to the high state before the light emitting control signal EMS transitions to the low state. However, embodiments of the present disclosure are not limited to such a specific length for which the low state of the reset signal RESET is maintained.

The fifth and sixth transistors M5 and M6 may turn on according to the light emitting control signal EMS. The fifth and sixth transistors M5 and M6 may turn on in a light emitting period TL and turn-off in a non-light emitting period TL.

When the fifth transistor M5 turns on in the light emitting period TL, the power supply line VL may be electrically connected to the second node N2, and thus, the first power supply voltage EVDD may be applied to the second node N2. As the first power supply voltage EVDD is applied to the second node N2, the first transistor M1 may receive the first power supply voltage EVDD.

As the data signal Vdata and the voltage corresponding to the threshold voltage of the first transistor M1 are stored in the first node N1 by the capacitor Cst, the first transistor M1 may allow a driving current corresponding to the data signal Vdata and the voltage corresponding to the threshold voltage of the first transistor M1 to flow from the second node N2 to the third node N3.

Further, when the sixth transistor M6 turns on in the light emitting period TL, the third node N3 may be electrically connected to the fourth node N4. Accordingly, the driving current may be supplied to the fourth node N4. When the driving current is supplied to the fourth node N4, a voltage in the fourth node N4 increases, and the driving current may flow through the light emitting element ED. As a result, the light emitting element ED may emit light.

When the fifth transistor M5 turns off in the non-light emitting period TN, the electrical connection of the power supply line VL to the second node N2 may be disconnected, and thus, the first power supply voltage EVDD may not be applied to the second node N2. Further, when the sixth transistor M6 turns off in the non-light emitting period TN, the electrical connection between the third node N3 and the fourth node N4 may be disconnected. Accordingly, the driving current may not be supplied to the fourth node N4.

However, even though the electrical connection between the third node N3 and the fourth node N4 is disconnected in the non-light emitting period TN, a voltage in the fourth node N4 may increase. When the fourth node N4 and the light emitting control line EML are disposed to be adjacent to each other, a capacitive coupling Cp may be formed between the fourth node N4 and the light emitting control line EML. Further, in the non-light emitting period TN, as the light emitting control signal EMS with the high state is supplied in the non-light emitting period TN, a voltage level at the fourth node N4 may increase by the capacitor Cp according to the light emitting control signal EMS with the high state supplied to the light emitting control line EML, and because of this, a voltage at the anode electrode of the light emitting element ED may increase.

When a voltage in the anode electrode of the light emitting element ED increases, as current may flow through the light emitting element ED, the light emitting element ED may emit light in the non-light emitting period TN. In particular, in a situation where the light emitting element ED emits light with a low gray scale, as shown in FIG. 4, when luminescence is adjusted by adjusting a duty ratio, there may occur a luminance reversal phenomenon in which luminance in a situation having a lower duty ratio is higher than luminance in a situation having a higher duty ratio.

However, in the non-light emitting period TN, as the reset voltage Vreset is applied to the fourth node N4 according to the reset signal RESET, it is possible to prevent the increase of the voltage in the anode electrode of the light emitting element ED in the non-light emitting period TN. As a result, such a luminance reversal phenomenon may be prevented.

The reset voltage Vreset may be supplied to the fourth node N4 according to the reset signal RESET, and in the third period T3, the reset signal RESET may be supplied in the low state according to the light emitting control signal EMS.

Figure 7:
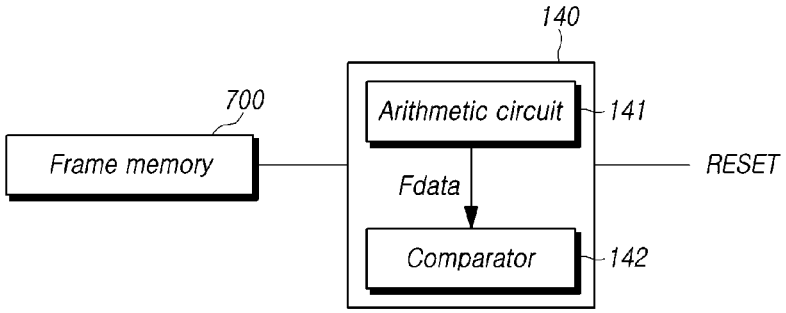
FIG. 7 is a structural diagram illustrating the operation of a timing controller illustrated in FIG. 1.

FIG. 7 is a structural diagram illustrating the operation of a timing controller illustrated in FIG. 1.

With reference to FIG. 7, the timing controller 140 may receive image signals (RGB) input in one frame on a plurality of frames basis included in images from a frame memory 700. The image signals RGB may be digital signals. The image signals (RGB) may include a red image signal, a green image signal, and a blue image signal. However, colors of image signals (RGB) according to embodiments herein are not limited thereto.

Further, the timing controller 140 may include an arithmetic circuit 141, and the arithmetic circuit 141 can generate frame data Fdata corresponding to the sum of image signals input in one frame. Further, the timing controller 140 can calculate luminance of the display panel in one frame corresponding to frame data Fdata using the arithmetic circuit 141.

Further, the timing controller 140 may include a comparator 142, and the comparator 142 can compare luminance of one frame of images calculated in the arithmetic circuit 141 and displayed in the display apparatus 100 with predetermined first luminance. According to a comparison result of the comparator 142, when the luminance of one frame of images calculated by the arithmetic circuit 141 and displayed in the display apparatus 100 is lower than the first luminance, the timing controller 140 may adjust the luminance of the display apparatus 100 by adjusting a pulse width of the light emitting control signal EMS.

When the luminance for one frame of images is lower than the first luminance, the timing controller 140 can control the gate driver 130 so that the light emitting control signal EMS has the plurality of first pulses in one frame. Further, the timing controller 140 can supply the reset signal RESET. The timing controller 140 can supply the reset signal RESET to the pixel 101 according to the light emitting control signal EMS. However, the supply of the reset signal RESET according to embodiments herein is not limited thereto. For example, the reset signal RESET may be supplied to the pixel 101 by the gate driver 130 based on the control of the timing controller 140.

Figure 8:
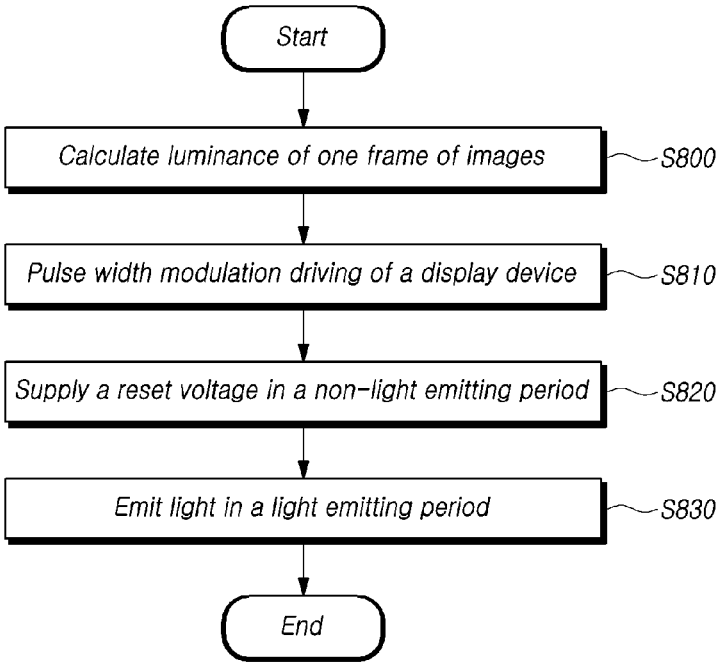
FIG. 8 is a flow diagram illustrating a method of driving a display apparatus according to an embodiment of the present disclosure.

FIG. 8 is a flow diagram illustrating a driving method of a display apparatus according to an embodiment of the present disclosure.

With reference to FIG. 8, the display apparatus 100 may calculate luminance in one frame of images displayed on a display panel 110, at step of S800. The display apparatus 100 can calculate frame data corresponding to one frame by summing image signals input to the display panel 110 on a per frame basis, and calculate luminance in the one frame based on the frame data.

Further, the display apparatus 100 may perform pulse width modulation driving, at step S820. The pulse width modulation driving enables luminance in the display apparatus 100 to be adjusted by adjusting a ratio between a length of a light emitting period TL and a length of a non-light emitting period TN according to luminance of the display apparatus 100 in one frame as the display apparatus 100 operates in a plurality of light emitting periods TL and a plurality of non-light emitting periods TN. The display apparatus 100 may operate in a plurality of light emitting periods TL and a plurality of non-light emitting periods TN by the light emitting control signal EMS, and the light emitting control signal EMS may include a plurality of first pulses corresponding to the plurality of non-light emitting periods. Further, by modulating a length of a pulse width of the light emitting control signal EMS, it is possible to adjust a ratio between a length of the light emitting period TL and a length of the non-light emitting period TN.

The display apparatus 100 may store data for predetermined first luminance in a memory, and calculate luminance for image signals input for one frame, and may compare the calculated luminance for the one frame with the first luminance. Further, when the luminance in one frame is lower than the first luminance, the display apparatus 100 may perform pulse width modulation driving. On the contrary, when the luminance in one frame is higher than the first luminance, the display apparatus 100 may determine luminance of the display apparatus 100 according to a voltage level of a data signal Vdata.

Further, the display apparatus 100 may include a plurality of pixels 101, and each pixel 101 may include a light emitting element ED, such as a light emitting diode or an organic light emitting diode, and a pixel circuit 101*p* for supplying a driving current to the light emitting element ED. The light emitting element ED may emit light by a driving current flowing according to a difference in voltages between an anode electrode and a cathode electrode. Further, a plurality of light emitting control lines for supplying a light emitting control signal EMS may be connected to each pixel 101.

A reset voltage Vreset may be supplied to the display panel 110 according to a plurality of non-light emitting periods TN, at step S820. When the plurality of light emitting control lines EML through which the light emitting control signal EMS is delivered are adjacent to the anode electrode or to a line allowing a driving current to flow into the anode electrode, capacitive coupling Cp may be formed between the light emitting control lines EML and the anode electrode or the line allowing the flow of the driving current. Such a line allowing the flow of the driving current into the anode electrode may include a place at which the second electrode of the sixth transistor M6 and the second electrode of the seventh transistor M7 are connected to each other, as shown in FIG. 5.

In a situation where such capacitive coupling Cp is formed between the light emitting control lines EML and the anode electrode, when a light emitting control signal EMS that is supplied to the light emitting control line EML in a non-light emitting period TN is supplied in the high state, a voltage level in the anode electrode of the light emitting diode ED may increase due to the capacitor Cp. When the anode electrode of the light emitting element ED increases, there may occur a problem that a current may flow from the anode electrode to the cathode electrode, and as a result, the light emitting element may emit light. However, as a reset voltage Vreset is supplied to the anode electrode of the light emitting element ED according to a plurality of non-light emitting periods TN, it is possible to prevent the increase of a voltage in the anode electrode of the light emitting element ED in the non-light emitting periods TN. Accordingly, the light emitting element ED can be prevented from emitting light in the non-light emitting periods TN.

The reset voltage Vreset may be applied to the anode electrode of the light emitting element ED according to a reset signal RESET. The reset voltage RESET may include a plurality of second pulses, and the second pulses may be supplied in sync with a plurality of first pulses of the light emitting control signal EMS. The plurality of second pulses each may maintain its state for one horizontal period.

Further, the display apparatus 100 can emit light according to a plurality of light emitting periods TL in one frame, at step S830. As the light emitting periods TL are repeatedly supplied in one frame in the display apparatus 100, thus, users may not perceive the occurrence of a flicker in a low gray scale.

It will be apparent to those skilled in the art that various modifications and variations can be made in the driving method and the display apparatus of the present disclosure without departing from the technical idea or scope of the disclosures. Thus, it may be intended that embodiments of the present disclosure cover the modifications and variations of the disclosure provided they come within the scope of the appended claims and their equivalents.

What is claimed is:

1. A display apparatus, comprising:

a display panel including at least one light emitting element that emits light according to a difference in respective voltages applied to an anode electrode and a cathode electrode, and including a plurality of pixels that are connected to a plurality of data lines, a plurality of gate lines, and a plurality of light emitting control lines, wherein a reset voltage is supplied to the anode electrode;

a data driver configured to supply a data signal to at least one of the plurality of data lines;

a gate driver configured to supply a gate signal to at least one of the plurality of gate lines and a light emitting control signal to at least one of the plurality of light emitting control lines; and a timing controller configured to control the data driver and the gate driver, and supply the reset voltage in sync with a plurality of non-light emitting periods of the light emitting control signal in one frame, wherein the light emitting control signal includes a plurality of first pulses corresponding to the plurality of non-light emitting periods in the one frame, and wherein when luminance of the display panel in the one frame is lower than a first luminance, a width of the plurality of first pulses is determined by luminance information on the luminance of the display panel, and a voltage level of the data signal corresponding to the one frame is constant.

2. The display apparatus according to claim 1, wherein the reset voltage is supplied in sync with the plurality of first pulses of the light emitting control signal.

3. The display apparatus according to claim 1, wherein when luminance of the display panel in the one frame is higher than a first luminance, the light emitting control signal maintains a constant voltage in the one frame, and a voltage level of the data signal corresponding to the one frame corresponds to a gray scale.

4. A display apparatus, comprising:

a display panel including at least one light emitting element that emits light according to a difference in respective voltages applied to an anode electrode and a cathode electrode, and including a plurality of pixels that are connected to a plurality of data lines, a plurality of gate lines, and a plurality of light emitting control lines, wherein a reset voltage is supplied to the anode electrode;

a data driver configured to supply a data signal to at least one of the plurality of data lines;

a gate driver configured to supply a gate signal to at least one of the plurality of gate lines and a light emitting control signal to at least one of the plurality of light emitting control lines; and a timing controller configured to control the data driver and the gate driver, and supply the reset voltage in sync with a plurality of non-light emitting periods of the light emitting control signal in one frame, wherein each of the plurality of pixels comprises:

a first transistor configured to supply a driving current from a second node to a third node by a voltage supplied to a first node and a first power supply voltage supplied to the second node;

a second transistor configured to supply the data signal to the second node according to a first gate signal;

a capacitor disposed between the first power supply voltage and the first node;

a third transistor configured to connect between the first node and the third node according to the first gate signal;

a fourth transistor configured to supply an initialization voltage to the first node according to a second gate signal;

a fifth transistor configured to supply the first power supply voltage to the second node according to the light emitting control signal;

a sixth transistor configured to supply the driving current supplied to the third node to a fourth node according to the light emitting control signal; and a seventh transistor configured to supply the reset voltage to the fourth node according to a reset signal, wherein the anode electrode of the light emitting element is connected to the fourth node.

5. The display apparatus according to claim 4, wherein the at least one light emitting control line is configured to apply the light emitting control signal to a gate electrode of the sixth transistor that is adjacent to the fourth node connected to the anode electrode of the light emitting element, or the at least one light emitting control line is configured to apply the light emitting control signal to a gate electrode of the sixth transistor that is disposed to overlap with the fourth node connected to the anode electrode of the light emitting element.

6. The display apparatus according to claim 4, wherein the light emitting control signal includes a plurality of first pulses corresponding to the plurality of non-light emitting periods in the one frame, and the reset voltage includes a plurality of second pulses supplied in sync with the plurality of first pulses of the light emitting control signal.

7. The display apparatus according to claim 6, wherein each of the second pulses of the reset signal has a length of one horizontal period.

8. The display apparatus according to claim 4, wherein the reset signal is supplied from the timing controller.

9. A method of driving a display apparatus, comprising:

calculating luminance of one frame of images displayed on a display panel;

comparing the calculated luminance with a first luminance, and when the calculated luminance is lower than the first luminance, enabling the display panel to be operated in a plurality of light emitting periods and a plurality of non-light emitting periods in the one frame;

supplying a reset voltage to the display panel according to the plurality of non-light emitting periods; and enabling light emitting to be performed in the display panel according to the plurality of light emitting periods in the one frame, wherein a light emitting control signal is applied to the display panel in the plurality of light emitting periods and the plurality of non-light emitting periods in the one frame, wherein the light emitting control signal includes a plurality of first pulses corresponding to the plurality of non-light emitting periods, wherein the one frame, a width of the plurality of first pulses is determined by luminance information on the luminance of the display panel, and a voltage level of a data signal corresponding to the one frame is constant.

10. The method according to claim 9, wherein the display panel comprises at least one pixel including a light emitting element, and a pixel circuit for supplying a driving current to the light emitting element, and the pixel and the pixel circuit are electrically connected to each other in at least one of the light emitting periods.

11. The method according to claim 9, wherein when the calculated luminance in the one frame is higher than the first luminance, a voltage level of a data signal in the one frame corresponds to a gray scale.

12. The method according to claim 10, wherein the light emitting element and the pixel circuit are electrically connected to each other by the light emitting control signal including a plurality of first pulses corresponding to the plurality of light emitting periods and the plurality of non-light emitting periods.

13. The method according to claim 10, wherein the reset voltage is transmitted to the display panel according to a reset signal, and the reset signal is supplied to the display panel from a timing controller.

* * * * *